US005175946A

United States Patent [19]

Tsai

[11] Patent Number: 5,175,946

[45] Date of Patent: Jan. 5, 1993

[54] INSOLE WITH REPLACEABLE PNEUMATIC BUFFER

[76] Inventor: Ming-En Tsai, 6Fl.-1, No. 698 Tunhwa S. Rd., Taipei, Taiwan

[21] Appl. No.: 757,849

[22] Filed: Sep. 11, 1991

[51] Int. Cl.[5] ..... A43B 13/20; A43B 13/38; A43B 13/40; A43B 21/28

[52] U.S. Cl. ..... 36/29; 36/3 R; 36/3 B; 36/35 R; 36/35 B; 36/37; 36/43; 36/71

[58] Field of Search ..... 36/3 R, 3 B, 28, 29, 36/35 R, 35 B, 37, 43, 44, 71, 92, 114

[56] References Cited

U.S. PATENT DOCUMENTS

| | | | |
|---|---|---|---|
| 1,771,793 | 7/1930 | Kind | 36/35 B |
| 2,106,788 | 2/1938 | Borman | 36/35 B |
| 2,365,027 | 12/1944 | Urbany | 36/29 |
| 2,597,393 | 5/1952 | Slampa | 36/35 B |
| 4,768,295 | 9/1988 | Ito | 36/35 R |
| 5,086,574 | 2/1992 | Bacchiocchi | 36/37 |
| 5,092,060 | 3/1992 | Frachey et al. | 36/29 |

FOREIGN PATENT DOCUMENTS

| | | | |
|---|---|---|---|
| 17718 | of 1907 | United Kingdom | 36/35 R |

*Primary Examiner*—Steven N. Meyers
*Assistant Examiner*—Marie D. Patterson
*Attorney, Agent, or Firm*—Lowe, Price, LeBlanc & Becker

[57] ABSTRACT

An insole includes a heel portion defining a recess. A replaceable pneumatic buffer defining a first and a second tubular elements is received in the recess of the insole. A central tunnel communicating with the first tubular element defines a hole. A plurality of tunnels communicate the first tubular element with the second tubular element. When load is exerted on the buffer, the second tubular element abuts a surface of the shoe, thereby defining a chamber filled with air. When the load increases excessively, air is ventable through the hole of the central tunnel and further off the chamber.

4 Claims, 2 Drawing Sheets

INSOLE WITH REPLACEABLE PNEUMATIC BUFFER

BACKGROUND OF THE INVENTION

The present invention relates to an insole for a shoe, more particularly, to an insole with a pneumatic buffer which releases air when a load exerted thereon is excessive and allows air therein when the load is removed.

Conventionally, a cell buffer is disposed under an insole to buffer pressure exerted on a wearer's feet. Referring to FIG. 1, a cell buffer 11 which is filled with air has a top 12 and a bottom 13 residing parallel to the top 12. Ribs 14 and 15 extend concentrically on an inner surface of the top 12.

A problem of the conventional cell buffer is that when an excessive load is exerted on the cell buffer 11, air is apt to burst out of the cell buffer 11, thereby rending the cell buffer 11.

The present invention is intended to obviate the above problems.

SUMMARY OF THE INVENTION

It is an object of the present invention to provide an insole including a replaceable pneumatic buffer.

It is another object of the present invention to provide an insole including a replaceable pneumatic buffer including a cell defining a hole for releasing an excessive load.

These and additional objects, if not specifically set forth herein, will be readily apparent to those skilled in the art from the detailed description of embodiments below, with reference of the accompanying drawings.

DETAILED DESCRIPTION OF THE PREFERRED EMBODIMENT

Figure 2:
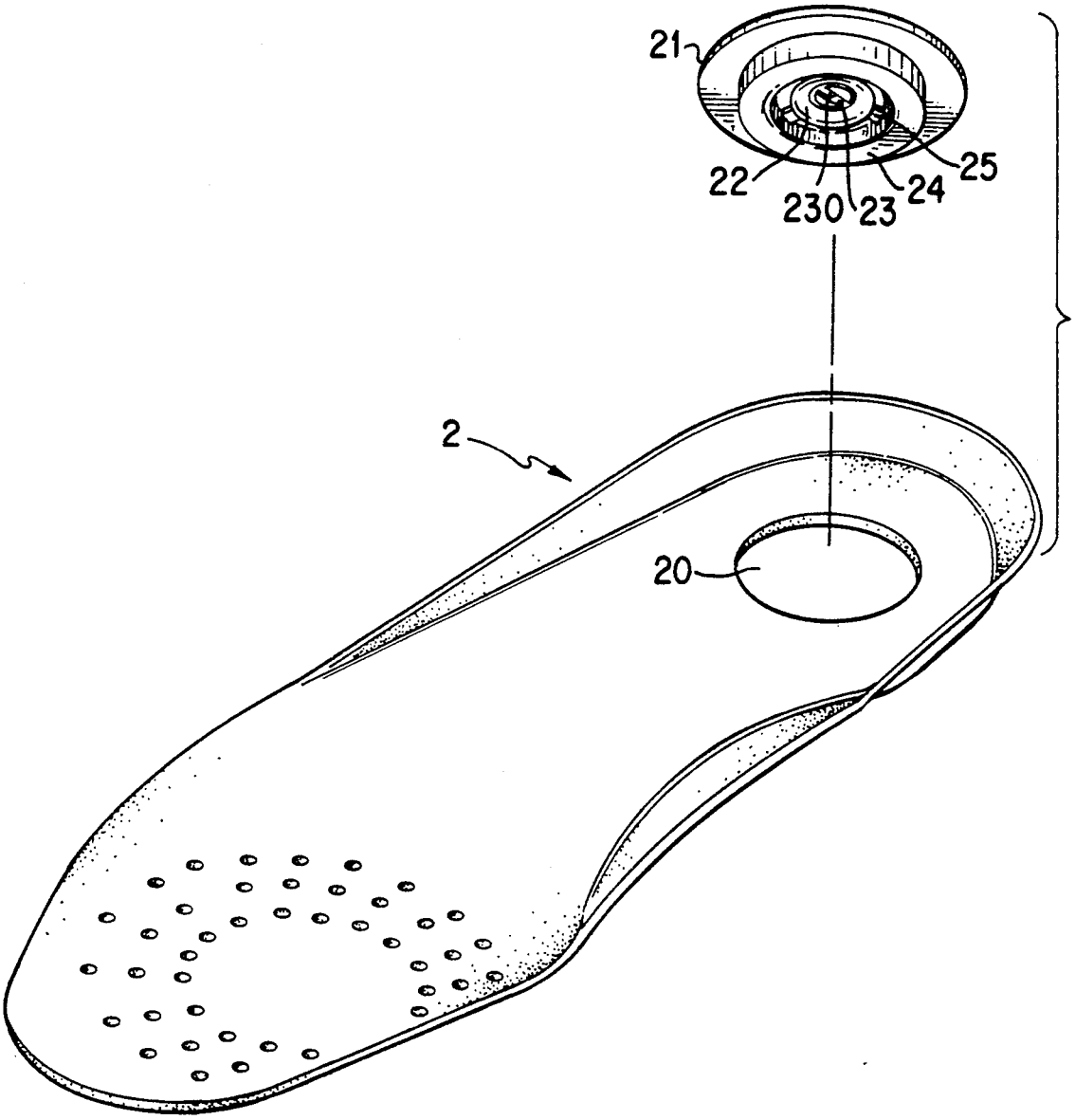
FIG. 2 is a perspective view of an insole including a pneumatic buffer in accordance with the present invention.

Referring to FIG. 2, an insole 2 includes a recess 20 within which a pneumatic buffer 21 fits. The buffer 21 has an inner tubular element 22 extending in a circle, a first tunnel 23 including two ends, each communicating with the inner tubular element 22 and defining a hole 230, an outer tubular element 24 extending around the inner tubular element 22, and a plurality of second tunnels 25, each communicating the inner tubular element 22 with the outer tubular element 24.

Figure 1:
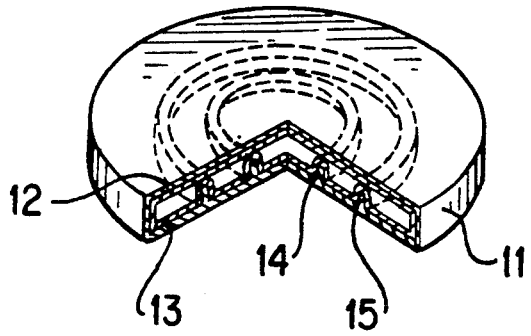
FIG. 1 PRIOR ART
FIG. 1 is a perspective view of a cell buffer in accordance with prior art.
Figure 3:
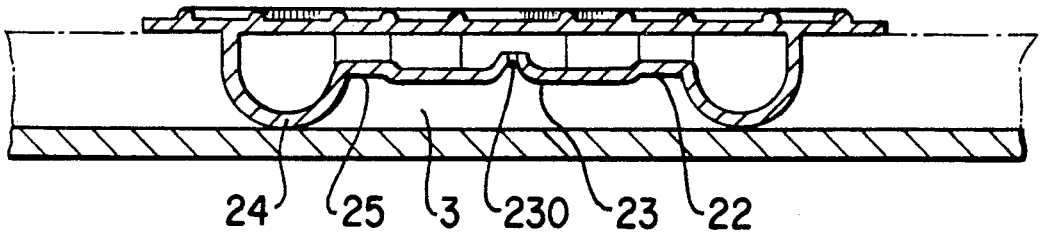
FIG. 3 is a cross sectional view of the pneumatic buffer of FIG. 2, showing the insole subject to a durable load, in accordance with the present invention.

Referring to FIG. 3, a diameter of the inner tubular element 22 is less than a diameter of the outer tubular element 24. The diameter of the inner tubular element 22 is no less than a diameter of the first tunnel 23. The diameter of the inner tubular element 22 is greater than a diameter of the second tunnel 25.

When a load is exerted on the buffer 21, the outer tubular element 24 is depressed to abut a surface of the shoe, thereby defining a chamber 3 filled with air. At this stage, tightness between the outer tubular element 24 and the surface of the shoe is adequate to restrain air within the chamber 3.

When the load increases, the inner tubular element 23 is also depressed to abut the surface of the shoe.

Figure 4:
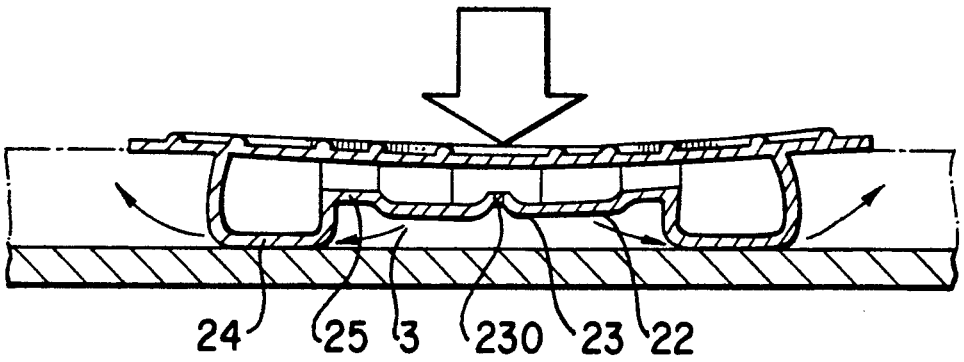
FIG. 4 is a cross sectional view of a pneumatic buffer of FIG. 2, showing the insole subject to an excessive load, in accordance with the present invention.

Referring to FIG. 4, when the load further increases, air is ventable out of the buffer 21 through the hole 230, thereby releasing pressure of the buffer 21, preventing explosion. When the load further increases, air pressure within the chamber 3 becomes excessive. The tightness between the outer tubular element 24 and the surface of the shoe is not adequate to restrain air within the chamber 3, thereby allowing air to be ventable out of the chamber 3.

When the load is removed, air is drawn into the chamber 3 formed by the tubular element 25 and the surface of the shoe, and further into the buffer 21 as the buffer 21 recovers.

While the present invention has been explained in relation to its preferred embodiment, it is to be understood that various variations thereof will be apparent to those skilled in the art upon reading this specification. Therefore, the invention disclosed herein is intended to cover all such variations as shall fall within the scope of the appended claims.

What I claim is:

1. An insole including a heel portion defining a recess and a buffer releasably fitting in said recess said buffer comprising:

a first tubular element extending in a closed curve;

a first tunnel communicating with said first tubular element and defining a hole;

a second tubular element extending around the first tubular element; and a plurality of tunnels, each communicating between the first tubular element and the second tubular element.

2. An insole in accordance with claim 1, wherein said first tubular element has a diameter less than the diameter of said second tubular element, said first tunnel has a diameter less than said diameter of said first tubular element, and said plurality of tunnels each have diameters less than that of said first tubular element.

3. An insole including a heel portion defining a recess and a buffer releasably fitted in said recess said buffer comprising:

a first tubular element extending in a circle;

a central tunnel communicating with said first tubular element and defining a hole;

a second tubular element extending around the first tubular element; and a plurality of tunnels, each communicating between the first tubular element and the second tubular element.

4. An insole in accordance with claim 3, wherein said first tubular element has a diameter less than that of said second tubular element, said central tunnel has a diameter less than the diameter of said first tubular element, and said plurality of tunnels each have diameters less than that of said first tubular element.

* * * * *